United States Patent [19]

Fukui

[11] Patent Number: 4,928,951

[45] Date of Patent: May 29, 1990

[54] AUTOMATIC PAPER FEED DEVICE

[75] Inventor: Kazuyuki Fukui, Osaka, Japan

[73] Assignee: Minolta Camera Kabushiki Kaisha, Osaka, Japan

[21] Appl. No.: 261,993

[22] Filed: Oct. 24, 1988

[30] Foreign Application Priority Data

Oct. 28, 1987 [JP] Japan ..... 62-272885

[51] Int. Cl.[5] ..... B65H 3/06

[52] U.S. Cl. ..... 271/113; 271/117; 271/122

[58] Field of Search ..... 271/10, 113, 117, 118, 271/122, 126, 127, 147, 162

[56] References Cited

U.S. PATENT DOCUMENTS

| | | | |
|---|---|---|---|
| 3,588,106 | 6/1971 | Csaba et al. | 271/117 |
| 4,496,145 | 1/1985 | Fukui . | |
| 4,515,358 | 5/1985 | Fukui . | |
| 4,576,371 | 3/1986 | Takahashi et al. | 271/296 |
| 4,801,134 | 1/1989 | Yokoyama et al. . | |
| 4,822,023 | 4/1989 | Miyoshi . | |

FOREIGN PATENT DOCUMENTS

| | | | |
|---|---|---|---|
| 3334522 | 3/1984 | Fed. Rep. of Germany | 271/126 |
| 257844 | 11/1986 | Japan | 271/118 |

*Primary Examiner*—H. Grant Skaggs

*Attorney, Agent, or Firm*—Wenderoth, Lind & Ponack

[57] ABSTRACT

An automatic paper feed device includes a first paper feed roller rotating in pressing contact with the upper surface of a sheet stack for feeding upper sheets from the sheet stack by its rotation in a counterclockwise direction, a second paper feed roller located downstream of the first paper feed roller with respect to the paper feeding direction and rotating in a counterclockwise direction for feeding only an uppermost sheet of the sheets fed by the first paper feed roller, a separating roller rotating in a direction opposed to the paper feeding direction while being held in pressing contact with the second paper feed roller for returning the sheets other than the uppermost sheet toward the sheet stack, a first frame rotatably supporting said first paper feed roller and a second frame rotatably supporting said separating roller, a paper feed unit pivotably supported so as to be pivotable in upward and downward directions so that the first paper feed roller descends to a level corresponding to the height of the sheet stack while being held in pressing contact with the upper surface of the sheet stack, and a guide associated with the first and second frames for guiding the copying sheet to a nip portion between the second paper feed roller and the separating roller.

9 Claims, 2 Drawing Sheets

AUTOMATIC PAPER FEED DEVICE

BACKGROUND OF THE INVENTION

1. Field of the invention

The present invention relates to an automatic paper feed device for use in electrophotographic copying machines, printers, or the like.

2. Description of the Prior Art

In the prior automatic paper feed devices, copying sheets stacked on a support plate in a paper feed cassette are pushed up to a predetermined level by a motor or a spring as a driving source so that the upper surface of the sheet stack is held in pressing contact with a paper feed roller. Subsequently, upper sheets are fed from the paper feed cassette toward a nip portion between another paper feed roller located downstream of said paper feed roller with respect to a paper feeding direction (hereinafter, this paper feed roller and the paper feed roller in pressing contact with the upper surface of the sheet stack are respectively referred to second and first paper feed rollers) and a separating roller in pressing contact with the second paper feed roller by the rotation of the first paper feed roller. At this time, the separating roller rotates in a direction opposed to the paper feeding direction for preventing a plurality of sheets from being fed simultaneously into the copying machine. As a result, only an uppermost sheet is fed in a transfer section.

However, the automatic paper feed device of this type is relatively large and expensive due to the fact that a pushing mechanism is required for pushing up a support plate on which the sheets are stacked.

Further, there arises a problem in that the pressure between the upper surface of the sheet stack and the first paper feed roller is not uniformly maintained because the pushing up of the support plate is intermittently carried out while the height of the upper surface of the sheet stack is detected.

SUMMARY OF THE INVENTION

The main object of the present invention is to provide a compact and inexpensive automatic paper feed device in which the first paper feed roller is held in pressing contact with the uppermost surface of the sheets stacked on the support plate without the sheet stack being pushed up by a pushing mechanism.

Another object of the present invention is to provide an automatic paper feed device which is adapted to constantly feed the copying sheets from the paper feed cassette with certainty.

These and other objects are achieved by providing an automatic paper feed device according to the invention which comprises a first paper feed roller rotating in pressing contact with the upper surface of the sheet stack for feeding upper sheets from the sheet stack by its rotation in a counterclockwise direction, a second paper feed roller located downstream of said first paper feed roller with respect to the paper feeding direction and rotating in the counterclockwise direction for feeding only an uppermost sheet of the sheets fed by said first paper feed roller, a separating roller rotating in a direction opposed to the paper feeding direction while being held in pressing contact with said second paper feed roller for returning the sheets other than said uppermost sheet toward the sheet stack, a first frame rotatably supporting said first paper feed roller and a second frame rotatably supporting said separating roller, a paper feed unit pivotably supported so as to be pivotable in upward and downward directions wherein the first paper feed roller descends to a level corresponding to the height of the sheet stack while being held in pressing contact with the upper surface of the sheet stack, and a guide means associated with said first and second frame for guiding the copying sheets to a nip portion between said second paper feed roller and said separating roller.

These and other objects, advantages and features of the invention will become apparent from the following description thereof taken in conjunction with the accompanying drawings which illustrate a specific embodiment of the invention.

BRIEF DESCRIPTION OF THE DRAWINGS

In the following description, like parts are designated by like reference numbers throughout the several drawings.

DETAILED DESCRIPTION OF THE INVENTION

An embodiment in accordance with the present invention will be described with reference to the drawings hereinafter.

Figure 1:
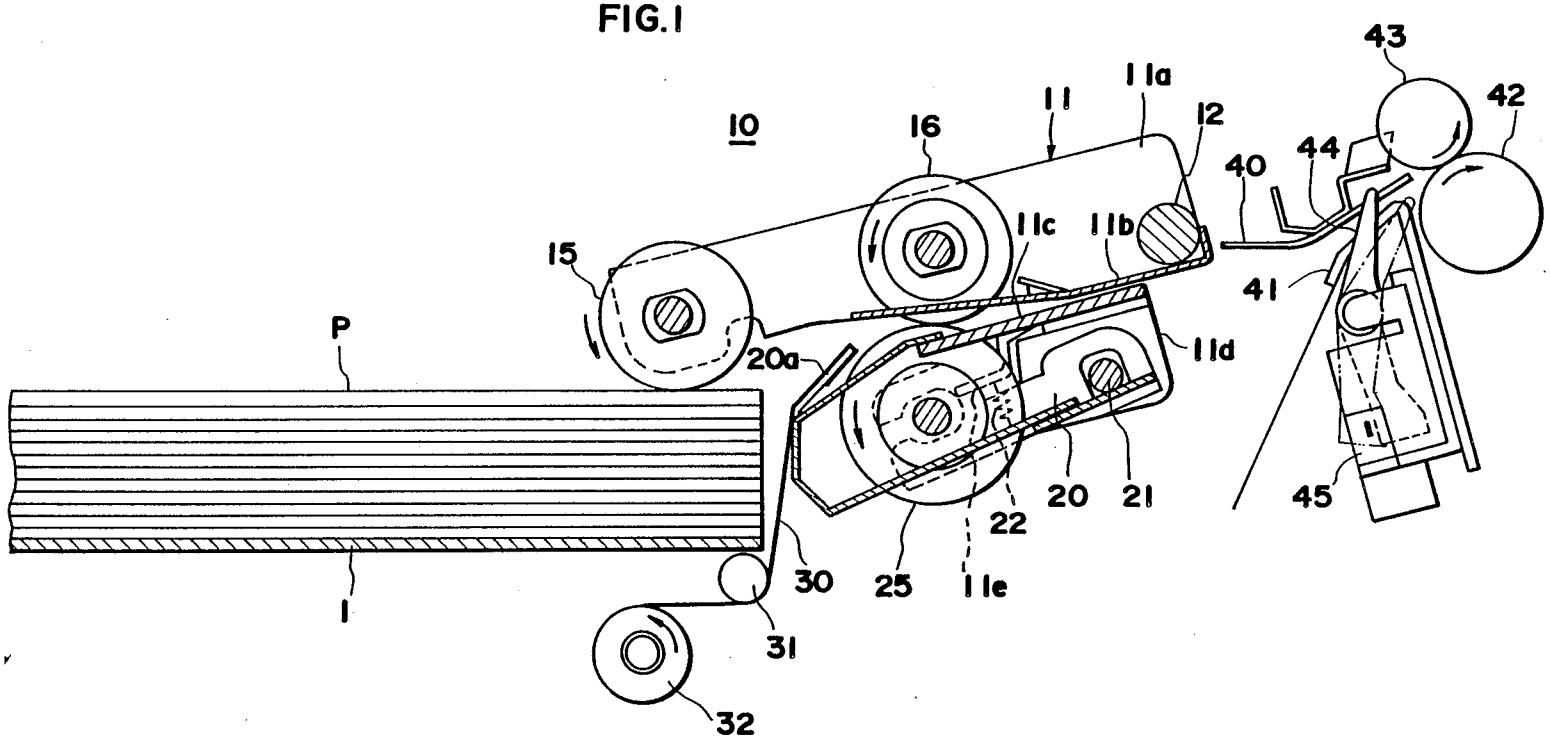
FIG. 1 is a cross-sectional view of the present invention illustrating an operating state in which copying sheets are stacked to substantially fill a paper feed cassette arranged at an automatic paper feed device of the present invention.
Figure 2:
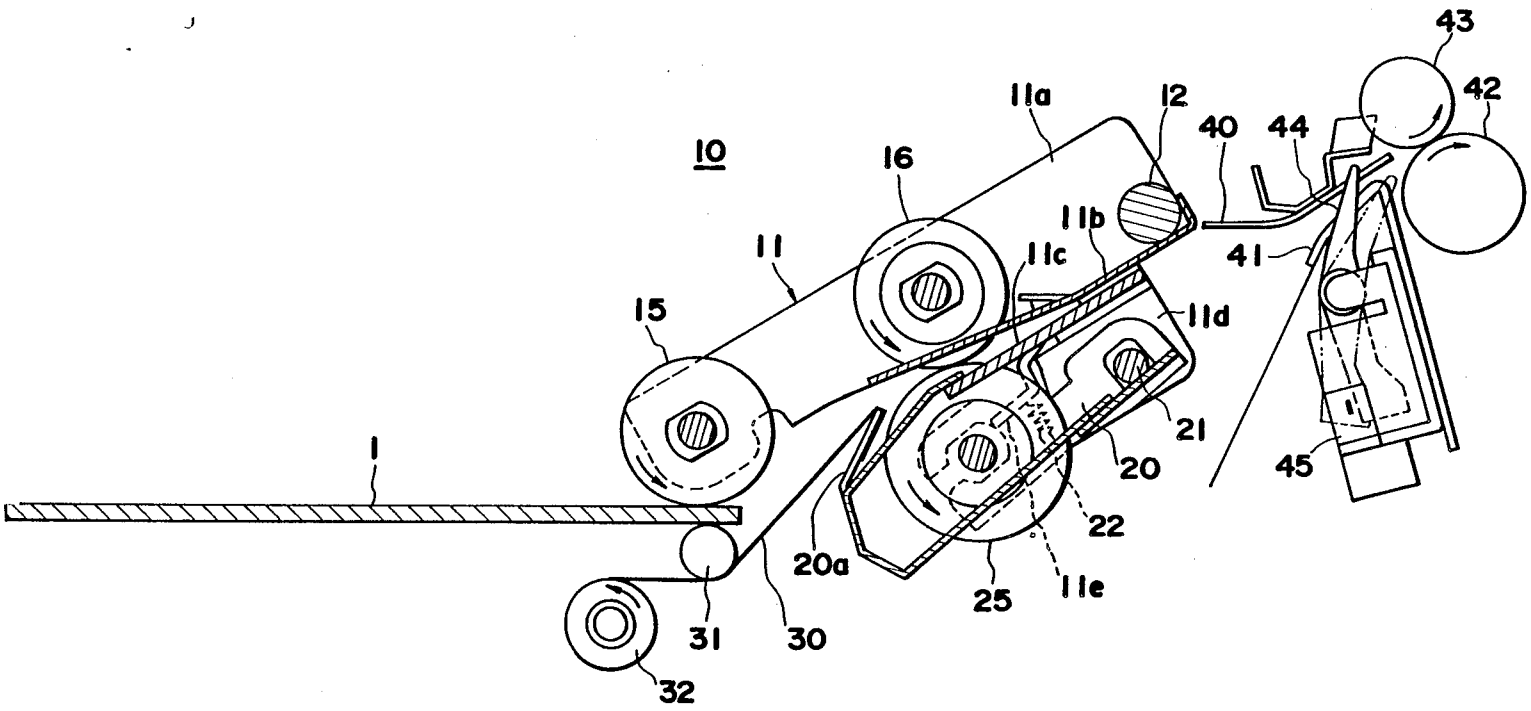
FIG. 2 is a cross-sectional view similar to FIG. 1 but illustrating an operating state in which every copying sheet has been fed from the cassette.

FIG. 1 shows an operating state in the invention in which copying sheets P are stacked to substantially fill a tray 1 in a paper feed cassette, and FIG. 2 shows operating state in which every copying sheet has been fed from the paper feed cassette. The tray 1 is fixed to a paper feed section of a copying machine at a predetermined level therein.

A paper feed unit 10 comprises first and second feed rollers 15 and 16, both of which are rotatably supported by a first frame 11, and a separating roller 25 rotatably supported by a second frame 20. It is to be noted here that both the first frame 11 and the second frame 20 are included in the paper feed unit 10. Therefore, the paper feed unit 10 supports the first and second paper feed rollers 15 and 16 and the separating roller 25.

The first frame 11 comprises a base plate portion **11*a*, guide plate portions 11*b* and 11*c*, and a supporting portion 11*d* for supporting the second frame 20 and is pivotably supported at a shaft 12 so as to move therearound in the upward and downward directions. The second frame 20 is pivotably supported at the supporting portion 11*d* through a shaft 21 so as to move therearound in the upward and downward directions. In addition, the second frame 20 is urged upward by a extension spring 22 disposed between the second frame 20 and a projecting portion 11*e*. The separating roller 25 is elastically held in pressing contact with the second paper feed roller 16 by said extension spring 22. Further, the second frame 20 is provided with a first guide plate 20*a* for guiding copying sheets P fed from the paper feed cassette toward the nip portion between the second paper feed roller 16 and the separating roller 25**.

The above-mentioned three rollers 15, 16 and 25 are respectively and rotatably driven in a counterclockwise direction by an unillustrated driving system. These rollers are controlled so as to be switched on and off in a predetermined timing.

A guide belt 30 is fixed to the first guide plate 20*a* at a leading end thereof. This guide belt 30 is taken up by a take-up roller 32 through an idle roller 31 arranged under the leading edge of the tray 1. The take-up roller 32 is caused to rotate in the counterclockwise direction as shown in FIG. 1 by an unillustrated torsion spring for constantly exerting tension on the guide belt 30.

Meanwhile, arranged downstream of the paper feed unit 10 with respect to the paper feed direction are guide plates 40 and 41, transporting rollers 42 and 43, and a photosensor provided with an actuator 44 for detecting the copying sheet. The above-mentioned shaft 12 is located close to the edge portion of said guide plate 40, and the edge portion of the guide plate portion 11*b* included in the first frame 11 extends to a location close to the guide plate 40.

The paper feed unit 10 is pivotably supported at the shaft 12 so as to move therearound in the upward and downward directions. The first paper feed roller 15 is in pressing contact with the uppermost one of the copying sheets P stacked on the tray 1 under its own weight due to and the tension on the guide belt 30. The pressure between the first paper feed roller and the surface of the uppermost copying sheet (the paper feeding pressure) is set at about 100 to 250 grams.

This paper feeding pressure can be established by employing an unillustrated auxiliary spring if necessary.

When the paper feed signal is switched on, the first paper feed roller 15, the second paper feed roller 16, and the separating roller 25 are respectively driven to rotate in the counterclockwise direction. At first, the upper sheets are fed by the rotation of the first paper feed roller 15. Subsequently, the sheets fed by the first paper feed roller 15 are transported to the nip portion between the second paper feed roller 16 and the separating roller 25 while guided by the guide belt 30 and the first guide plate 20*a*. Although a few sheets are simultaneously fed from the paper feed cassette due to the friction among those sheets, only an uppermost sheet is fed in the rightward direction in FIG. 1 by the rotation of the second paper feed roller 16 and the other sheets are returned to the tray 1 by the rotation of the separating roller 25. The uppermost sheet is guided by second and third guide plates 40 and 41 to be transported toward the transfer section (not shown) by first and second transporting rollers 42 and 43.

The second paper feed roller 16, the separating roller 25, and the copying sheet are selected to satisfy the relationship of $U_1 > U_2 > U_3$, wherein the coefficient of the friction between the second paper feed roller 16 and the sheet is $U_1$, that between the separating roller 25 and the sheet is $U_2$, and that between the sheets is $U_3$. Accordingly, the upper sheets fed from the paper feed cassette are separated to be transported one by one through the nip portion between the second paper feed roller 16 and the separating roller 25.

The pressure exerted by the first paper feed roller 15 is maintained uniform because the paper feed unit 10 descends while pivoting about the shaft 12 as the sheets stacked on the tray 1 are fed from the paper feed cassette. The positional relationship between the first and second paper feed rollers 15 and 16, as well as that between the separating roller 25 and the first guide plate 20*a*, is also maintained uniform despite the pivotable movement of the paper feed unit 10 in upward and downward directions.

Although the distance from the leading end of the uppermost copy sheet to the guide plate 20*a* becomes great as the copy sheets P are fed from the paper feed cassette, the leading end of the sheets are certainly guided by the guide belt 30 in order to be transported from the first guide plate 20*a* toward the nip portion between the second paper feed roller 16 and the separating roller 25.

Further, the shaft 12 is positioned close to the edge of the second guide plate 40 and the guide plate portion 11*b* of the first frame 11 extends to a location close to the second guide plate 40. Therefore, the guide plate portion 11*b* and the second guide plate 40 can successively guide the sheet to the transfer section without being adversely influenced by the pivotal movement of the paper feed unit 10.

Meanwhile, the entire paper feed unit 10 is lifted with the first paper feed roller 15 when the copying sheets are stacked in the tray 1. In response to the lifting movement of the paper feed unit 10, the guide belt 30 is moved to extend in a substantially vertical direction to thereby push back the remaining sheets on the tray 1 toward the tray edge confronting the paper feed unit 10.

As will be clearly understood from the foregoing description, according to the present invention, the first feed roller in pressing contact with the uppermost copying sheet, the second feed roller and the separating roller serving as a separating mechanism are formed as a unit, said unit being pivotably supported in the upward and downward directions. With this structure, the first feed roller is in pressing contact under its own weight with the uppermost copying sheet at a predetermined pressure corresponding to the height of the remaining sheets, with the result that there is no need to provide a conventional mechanism for pushing up the paper feed cassette whereby a small-sized and inexpensive device can be realized.

In addition, each roller is supported by provided at the frames forming a unit, facilitating the assembly of the rollers into the device, the exchange and the cleaning of the rollers and improving the positional accuracy among the rollers.

Further, the guide belt not only forms a proper guide surface corresponding to the height of a stack of sheets but also urges the paper feed unit downwardly. It is to be noted here that the guide belt extends substantially vertically with respect to the support plate in order to push back the leading end of the remaining sheets toward the support plate edge confronting the paper feed unit.

Although the present invention has been fully described by way of examples with reference to the accompanying drawings, it is to be noted that various changes and modifications will become apparent to those skilled in the art. Therefore, unless such changes and modifications otherwise depart from the scope of the present invention, they should be construed as being included therein.

What is claimed is:

1. An automatic feed device for feeding sheets from a stack thereof one at a time in a sheet feed direction, said device comprising:

a feed frame including a shaft having an axis of rotation about which said feed frame is pivotally supported in the device;

a first feed roller rotatably supported by said feed frame about an axis of rotation of said first feed roller spaced from the axis of rotation of said feed frame;

a second feed roller rotatably supported by said feed frame about an axis of rotation of said second feed roller spaced from the axis of rotation of said feed roller, said second feed roller disposed downstream of said first feed roller with respect to the feed direction in which sheets are fed in the device;

a separating roller, and a support means rotatably supporting said separating roller in the device in pressing contact with said second feed roller, said support means operatively engaged with said feed frame in a manner in which said separating roller supported by said support means moves in conjunction with pivotal movement of said feed frame in the device about the axis of rotation of said feed frame; and guide means disposed adjacent said separating roller for guiding sheets in the feed direction in the device to the nip between said second feed roller and said separating roller in pressing contact therewith.

2. An automatic paper feed device as claimed in claim 1, wherein said guide means comprises a flexible belt having one end thereof connected to said support means.

3. An automatic paper feed device as claimed in claim 2, wherein said guide means further comprises a take-up roller means to which the other end of said flexible belt is connected for exerting tension on said belt.

4. An automatic paper feed device as claimed in claim 1, and further comprising a support plate for supporting a stack of sheets below said first feed roller in the device, and wherein said guide means includes an idler roller disposed below said support plate, said flexible guide belt passing over said idler roller.

5. An automatic paper feed device for feeding copying sheets in a copy sheet feed direction, said device comprising:

a support plate fixed in the device for supporting a stack of copy sheets, a feed frame including a shaft having an axis of rotation about which said feed frame is pivotally supported in the device;

a first feed roller rotatably supported by said feed frame about an axis of rotation of said first feed roller spaced from the axis of rotation of said feed frame, said first feed roller disposed above said support plate so as to be pressable against copy sheets supported by said support plate under a constant pressure due to the support of said first feed roller by said pivotal feed frame;

a second feed roller rotatably supported by said feed frame about an axis of rotation of said second feed roller spaced from the axis of rotation of said feed frame, said second feed roller disposed downstream of said first feed roller with respect to the feed direction in which copy sheets are fed in the device;

a separating roller, and a support means rotatably supporting said separating roller in the device in pressing contact with said second feed roller, said support means operatively engaged with said feed frame in a manner in which said separating roller supported by said support means moves in conjunction with pivotal movement of said feed frame in the device about the axis of rotation of said feed frame; and guide means disposed adjacent said separating roller for guiding sheets in the feed direction in the device to the nip between said second feed roller and said separating roller in pressing contact therewith.

6. An automatic paper feed device as claimed in claim 5, wherein said guide means comprises a flexible belt having one end thereof connected to said support means.

7. An automatic paper feed device as claimed in claim 6, wherein said guide means further comprises a take-up roller means to which the other end of said flexible belt is connected for exerting tension on said belt.

8. An automatic paper feed device as claimed in claim 6, wherein said guide means includes an idler roller disposed below said support plate, said flexible guide belt passing over said idler roller.

9. An automatic paper feed device as claimed in claim 6, wherein said belt comprises elastic material.

* * * * *